US006487884B1

(12) United States Patent
Constantinou

(10) Patent No.: US 6,487,884 B1
(45) Date of Patent: Dec. 3, 2002

(54) ELECTRICALLY CONTROLLED LOCK

(75) Inventor: John Constantinou, North Ringwood (AU)

(73) Assignee: Lockwood Security Products Pty, Limited, Huntingdale (AU)

( * ) Notice: Subject to any disclaimer, the term of this patent is extended or adjusted under 35 U.S.C. 154(b) by 0 days.

(21) Appl. No.: 09/719,216

(22) PCT Filed: Jun. 11, 1999

(86) PCT No.: PCT/AU99/00453

§ 371 (c)(1),
(2), (4) Date: Feb. 7, 2001

(87) PCT Pub. No.: WO99/64704

PCT Pub. Date: Dec. 16, 1999

(30) Foreign Application Priority Data

Jun. 11, 1998 (AU) ..... 4007

(51) Int. Cl.[7] ..... E05B 47/00

(52) U.S. Cl. ..... 70/277; 70/279.1; 70/283; 70/472

(58) Field of Search ..... 70/218, 219, 222–224, 70/277–283, 149, 472

(56) References Cited

U.S. PATENT DOCUMENTS

| | | | | | |
|---|---|---|---|---|---|
| 3,939,679 | A | * | 2/1976 | Barker et al. | 70/277 |
| 4,073,527 | A | * | 2/1978 | Schlage | 292/347 |
| 4,177,657 | A | * | 12/1979 | Aydin | 70/278 |
| 4,526,256 | A | | 7/1985 | Urdal | 192/40 |
| 4,671,087 | A | * | 6/1987 | Olenfalk et al. | 70/283 |
| 4,749,072 | A | * | 6/1988 | Lichty et al. | 192/40 |
| 5,018,375 | A | | 5/1991 | Tully | 70/472 |
| 5,447,047 | A | | 9/1995 | Lin | 70/218 |
| 5,475,996 | A | * | 12/1995 | Chen | 70/279 |
| 5,628,216 | A | * | 5/1997 | Qureshi et al. | 70/279 |
| 5,715,715 | A | * | 2/1998 | Nunez | 70/283 |
| 5,931,430 | A | * | 8/1999 | Palmer | 70/449 X |
| 5,960,656 | A | * | 10/1999 | Yao | 70/472 |
| 5,992,195 | A | * | 11/1999 | Huang et al. | 70/472 |
| 6,062,612 | A | * | 5/2000 | Lin | 292/144 |
| 6,178,794 | B1 | * | 1/2001 | Eller et al. | 70/472 |
| 6,223,567 | B1 | * | 5/2001 | Fadul | 70/149 |

FOREIGN PATENT DOCUMENTS

| | | |
|---|---|---|
| AU | A-78877/94 | 5/1995 |
| DE | 195 02 288 A1 | 8/1996 |

* cited by examiner

*Primary Examiner*—Suzanne Dino Barrett
(74) *Attorney, Agent, or Firm*—Oppenheimer Wolff & Donnelly, LLP

(57) ABSTRACT

An electrically controlled lock (10), including a retractable latchbolt and a clutch mechanism disposed between a latchbolt retracting mechanism for retracting the latchbolt and a drive member (11) for driving the latchbolt retracting mechanism. The clutch mechanism includes a pair of engageable bodies (18, 22) which are relatively movable between an engaged condition in which drive of the drive member (11) is transmitted to the latchbolt retracting mechanism for retracting the latchbolt, and a disengaged condition in which transmission of drive between the drive member (11) and the latchbolt retracting mechanism is interrupted so as to prevent retraction of the latchbolt. The relative movement of the engageable bodies (18, 22) occurring as a result of engagement of at least one of the bodies with an actuating member (32) which is controlled by an electrical actuator (31). The actuating member (32) being movable between a first position facilitating disengagement of the engageable bodies (18, 22) and a second position displaced from the first position, and facilitating engagement of the engageable bodies (18, 22).

22 Claims, 8 Drawing Sheets

ELECTRICALLY CONTROLLED LOCK

The present invention relates to an electrically controlled lock for a door and is principally concerned with such locks that form part of a door closure installation which includes a latchbolt that is retractable under manual actuation of a lever or knob actuator disposed on at least one side of a door to which the lock is fitted to allow the door to be opened from a closed position.

Door closures that have the above kind of operation are well known in door installations and they can be locked to prevent door opening by a variety of different mechanisms. For example, some closures can be locked by arrangements which do not effect the operation of the levers or knobs, such as by a deadbolt which is operable independently of the levers or knobs. Alternatively, the lock may be arranged to act on the lever or knob such as to prevent its rotation so that the retracting mechanism for retracting the latchbolt cannot be actuated. Still alternatively, the lock can be arranged to act directly on the latchbolt retracting mechanism, or the latchbolt itself, to prevent latchbolt retraction. The present invention is concerned with arrangements of the latter kind, in which the door closure is locked when the latchbolt cannot be retracted.

It is an object of the present invention to provide an electrically controlled lock for a door closure which can assume either a locked or unlocked condition and in which movement between those conditions is controlled electronically. It is a further object of the invention to minimise the electric current drawn by the electronic control. It is still a further object to provide a mechanism to override the electronic control.

According to the present invention there is provided to an electrically controlled lock, including a retractable latchbolt and a clutch mechanism disposed between a latchbolt retracting mechanism for retracting said latchbolt and a drive member for driving said latchbolt retracting mechanism, said clutch mechanism including first and second engagable bodies which are connected to said drive member and said latchbolt retracting mechanism respectively, so that said drive member is operable to rotate said first engagable body and said latchbolt rectracting mechanism is operable upon rotation of said second engagable body, said engagable bodies being relatively movable between an engaged condition in which drive of said drive member is transmitted to said latchbolt retracting mechanism for retracting said latchbolt, and a disengaged condition in which transmission of drive between said drive member and said latchbolt retracting mechanism is interrupted so as to prevent retraction of said latchbolt, said relative movement of said engagable bodies occurring as a result of engagement of at least one of said bodies with an actuating member which is controlled by electrical actuating means to move between a non-actuated and an actuated position, in said non-actuated position said actuating member is disposed between said engagable bodies and is operable, upon drive by said drive member to rotate said first engagable body, to engage at least one of said first and second engagble bodies and to cause them to disengage, and in said actuated position, said actuating member is positioned to permit said engagable bodies to remain engaged upon rotation of said first engagable body by said drive member for transmission of drive through said second engagable body to said latchbolt retracting mechanism.

The actuating means can take any suitable form and can for example be an electrical motor that drives the actuating member. Alternatively the actuating means could be a solenoid and the actuating member is a plunger driven by the solenoid.

A lock according to the invention is advantageous for several reasons. In particular, electrically controlled locks are increasingly being used in commercial applications where access through a door is controlled by a signal recognition system, such as a validated magnetic or electric card or key system, which system reads a code and determines from that whether the door is to be unlocked. Such systems are useful not only to permit or prevent access through a door, but can also be used to electronically monitor and record movement past the door, such as the frequency and identity of personnel who gain door access.

An electrically controlled lock is further advantageous, as it can be programmed to react differently to the signals or codes of different personnel. Thus, personnel can be provided with different access availability by appropriate programming of the code reader. Reprogramming can also be relatively simple, so that the availability of access can be altered easily. Such reprogramming furthermore does not necessarily require the card or key to be programmed or changed. This differs from a traditional mechanical key system, in which access through a door is generally available as long as a person has in their possession, the relevant key. Thus, in that system access is difficult to control and if access is to be prevented, the key needs to be retrieved or the barrel of the lock changed. A further benefit of electrically controlled locks relates to the generally simplified unlocking of a door.

Electrically controlled locks have found widespread use in the hotel industry. In that industry, the locks can be programmed to permit a guest room door to be opened by a particular card given to a guest for the duration of his or her booking. At the end of that booking the lock can be reprogrammed so that further access to that guest by the card is not available. This renders the card ineffective to gain entry to the room until it is further reprogrammed. This is also a useful characteristic for other commercial and domestic buildings.

A lock according to the invention is applicable to installations in which a manually operable drive member is applied to only one side of the door, as well as to installations in which drive members are disposed on both sides of the door. The lock of the invention is particularly advantageous for installations of the latter kind in which a door is required to be opened from either side. In such installations, a drive member is disposed on either side of the door and a clutch mechanism may be applied to each drive member, or only one of those drive members. In an arrangement employing a clutch mechanism applied to only one of the drive members, the door can be locked from one side only and this arrangement is highly acceptable and preferred in many situations. In particular, that arrangement is preferred when the lock is applied to the door of a hotel guest room, because it facilitates easy egress from the room by operation of the drive member on the inside of the door which is permanently operable, but prevents entry through the door from the outside, unless the person attempting to gain entry has the correctly coded card, or other coded instrument. Accordingly, this system is also appropriate for areas to which restricted entry is gained past a door, but to which exit from that area need not be controlled.

A drive member which is suitable for the invention can be of a conventional form, such as a conventional drive lever or knob which can be rotated manually to operate the latchbolt retracting mechanism, with return rotation returning the latchbolt to its previous, normally extended position. Alternatively, the drive member may be of a different form and may itself may be electrically operated to activate the latchbolt retraction mechanism. The latchbolt retracting mechanism can also be of a conventional form, with modification as necessary to connect it to the clutch mechanism. Also, the electrical control that activates the actuating means can be of any suitable form which provides an electrical current in the desired manner.

In a preferred form, the engaging members of the clutch mechanism are cylindrical discs which in an engaged condition permit transmission of a drive load from the drive member to the latchbolt retracting mechanism by rotation of the engaging members. The engaging members can be engaged by any suitable means and in one arrangement, one of the engaging members includes at least one protruding portion that can be received within a recessed portion in the other of the engaging members and while the protruding portion remains received within the recessed portion, the drive load can be transmitted to the latchbolt retracting mechanism. The protruding and recessed portions are preferably disposed on facing engagable surfaces of the engaging members and separation of engaging members to remove the protruding portion(s) from the recess(es) serves to disengage the clutch mechanism.

The surface which is engaged by the actuating member may be provided in a recess and that recess may be formed on one of the engaging members, or be partially formed in both of the engaging members. The recess is preferably formed at the perimeter of the or each engaging member, particularly if these are formed as discs. Preferably the recess arrangement is such that the end of the actuating member can be accommodated in the recess without disengaging the engaging members until such time as the drive member is rotated. In that arrangement, the recess can be arranged, so that movement of the engaging member connected to the drive member is influenced by its engagement with the actuating member to move in a direction that disengages it from the other of the engaging members. Thus, in this arrangement, disengagement of the clutch mechanism only takes place when the drive member is operated. This arrangement is advantageous, in that the end of the actuating member can be disposed within the recess at all times and when the drive member is operated, the engaging bodies will be separated so that access through the door cannot be obtained. Advantageously, the actuating member can be removed from the recess by actuation of the solenoid actuator and in that removed condition, a rotational force applied to the drive member will be transmitted to the latchbolt retracting mechanism through the engaged clutch mechanism.

Where the recess is formed partially on both engaging members, the separate recess surfaces may be formed differently for engagement with the actuating member. In particular, one of the surfaces may include a profile that causes displacement of one engaging body relative to the other, such as by a ramped surface. Alternatively, all surfaces that come into contact with the actuating member may be contoured to promote the desired separation and these may also include appropriate abutment services to prevent rotation of the engaging members beyond a certain degree.

The present invention further provides an override mechanism which prevents disengagement of the clutch mechanism by the actuating means. The override mechanism is provided as a means to unlock a door when the means normally provided for that purpose has failed. That failure may be due to a lack of electrical energy, or to a mechanical breakdown in the actuating means, or to misplacement or loss of the card that actuates the actuating means.

It is a principle function of the override mechanism that the actuating member is removed from the position at which it disengages the clutch mechanism so that the latchbolt can be retracted by rotation of the drive member. This can be achieved in any suitable manner, but in a preferred form, the override mechanism causes movement of the actuating member to a position in which the plunger end cannot adopt the disengagement position relative to the clutch mechanism. That movement can be in any suitable direction and in a preferred form the movement is rotary. Alternatively the movement can be linear. The override mechanism can be operated by mechanical or electrical means and in a preferred form includes a cylinder assembly that is key operated and the barrel of which rotates in engagement with the actuating member, to displace the actuator or which causes the actuating member to be displaced from the disengaging position.

The attached drawings show an example embodiment of the invention included in an assembly of the foregoing kind. The particularity of those drawings and the associated description does not supersede the generality of the preceding broad description of the invention.

Figure 1:
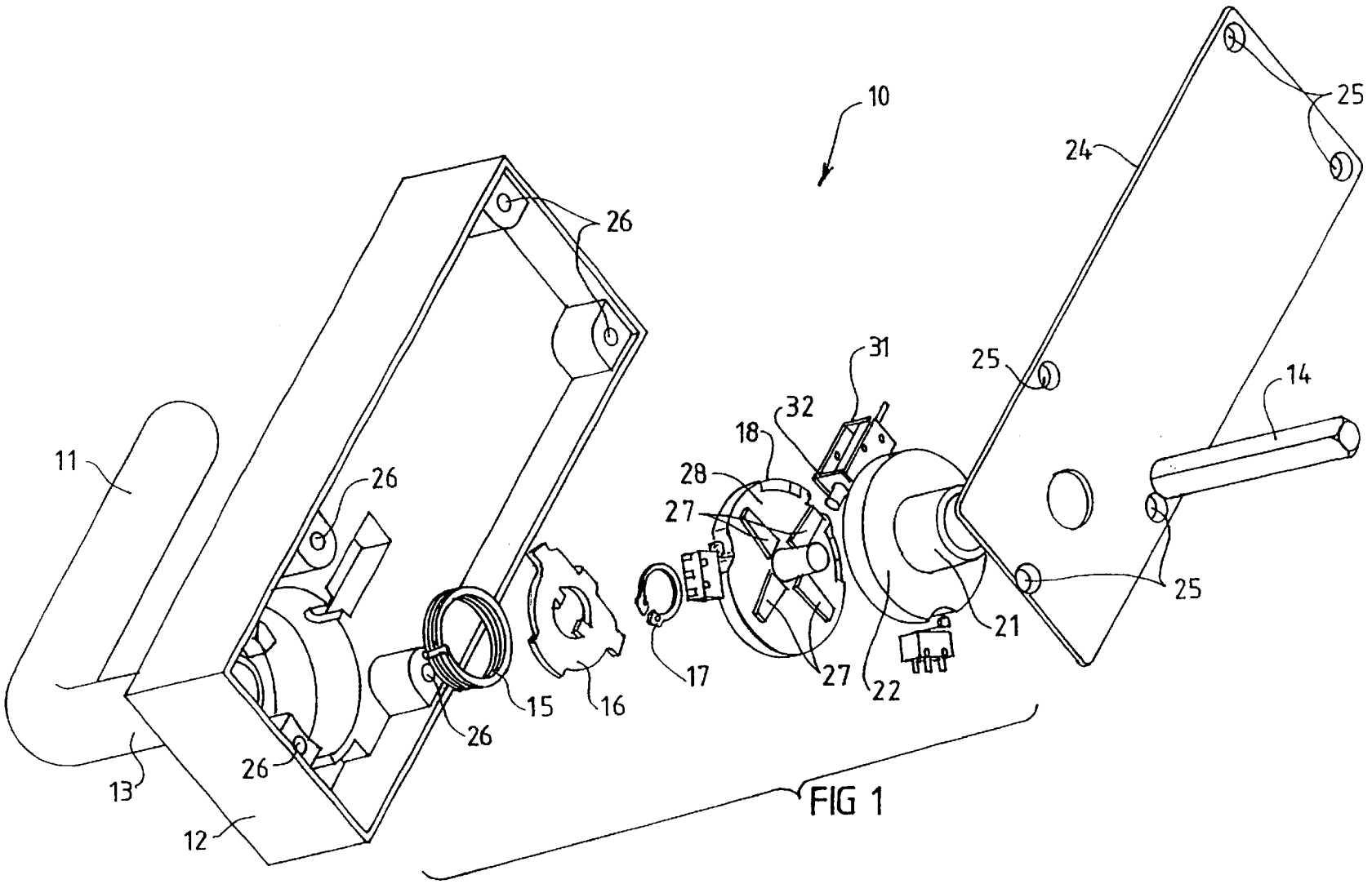
FIG. 1 is an exploded view of a lock according to the invention.

FIG. 1 shows an exploded view of a lock 10 according to the invention. The lock 10 includes a drive member in the form of a conventional lever handle 11, although the drive member could alternatively take the form of a knob also of a conventional form. The lever handle 11 is connected in a known manner to one side of a lock housing or case 12 and for simplicity of description the constructional detail of that connection will not be described. The connection provides for rotational movement of the lever handle 11 about the axis of a depending section 13 thereof and connected to that section is a spindle 19 (shown in FIG. 2), which is usually of square or hexagonal cross-section and which is received within a complimentary shaped bore in the depending section 13 so that rotation of the lever handle 11 results in rotation of the spindle 19.

The spindle 19 of the lever handle 11 extends through a coil spring 15, which is provided to return the lever handle 11 to its rest position as shown after it has been rotated, and an operating plate 16, and a circlip 17 engages within a groove in the spindle to locate the coil spring 15 and the operating plate 16 relative to the spindle 19. The bore in the depending section 13 is of a depth that permits movement of the spindle 19 into the bore from a normal rest position and that movement is against the biasing influence of a further coil spring positioned within the bore and the requirement for that movement is to facilitate disengagement of the clutch mechanism which will become apparent later. The other end of the spindle 19 is received within a disc 18 of the clutch mechanism and that disc is rotated about its central axis by the spindle 19 upon rotation of the lever handle 11. This arrangement is more clearly shown in FIG. 2 and in that figure, it can be seen that the disc 18 is a circular disc having substantially planar parallel front and rear faces. The disc 18 is connected to the spindle 19 within an opening 20 of complimentary square cross-section and the connection may permit sliding movement between the disc 18 and the spindle 19, or it may be fixed, such as by a friction or press fit, or by a step on the spindle 19.

The spindle 14 shown in FIG. 1 is also of square cross-section and is received within a square opening 23 (see FIG. 2) in a hub 21 of a disc 22. The disc 22 is, like the disc 18, of circular disc form and includes substantially planar parallel front and rear faces. The arrangement by which the disc 22 is connected to the spindle 14 results in rotation of the spindle 14 about its longitudinal axis upon rotation of the disc 22 about its central axis. At an end of the spindle remote from its connection to the disc 22, the spindle is connected to a latchbolt retracting mechanism in such a manner that rotation of the spindle 14 actuates the retracting mechanism to retract the latchbolt of the lock. The connection of the spindle 14 to a retracting mechanism, along with the form of a suitable mechanism for that purpose is well known and therefore will not be described in detail. The spindle 14 is also normally attached to a lever handle in the same manner as the lever handle 11 and spindle 19 respectively.

As will be described later, the discs 18 and 22 can be engaged to transmit rotation of one disc to the other, while they can also be disengaged to prevent that transmission. The discs must therefore be arranged to engage and separate when necessary and in one arrangement, each disc is fixed to its respective spindle and separation of the discs results in movement of the spindles into the lever handle bores against the biasing influence of the coil springs located within the bores. Alternatively, the discs can be slidably fixed to the respective spindles, with biasing means being provided to engage the discs, and separation of the discs occurring against the influence of the biasing means. Still alternatively, a combination of these arrangements, or different arrangements can be employed.

Figure 3:
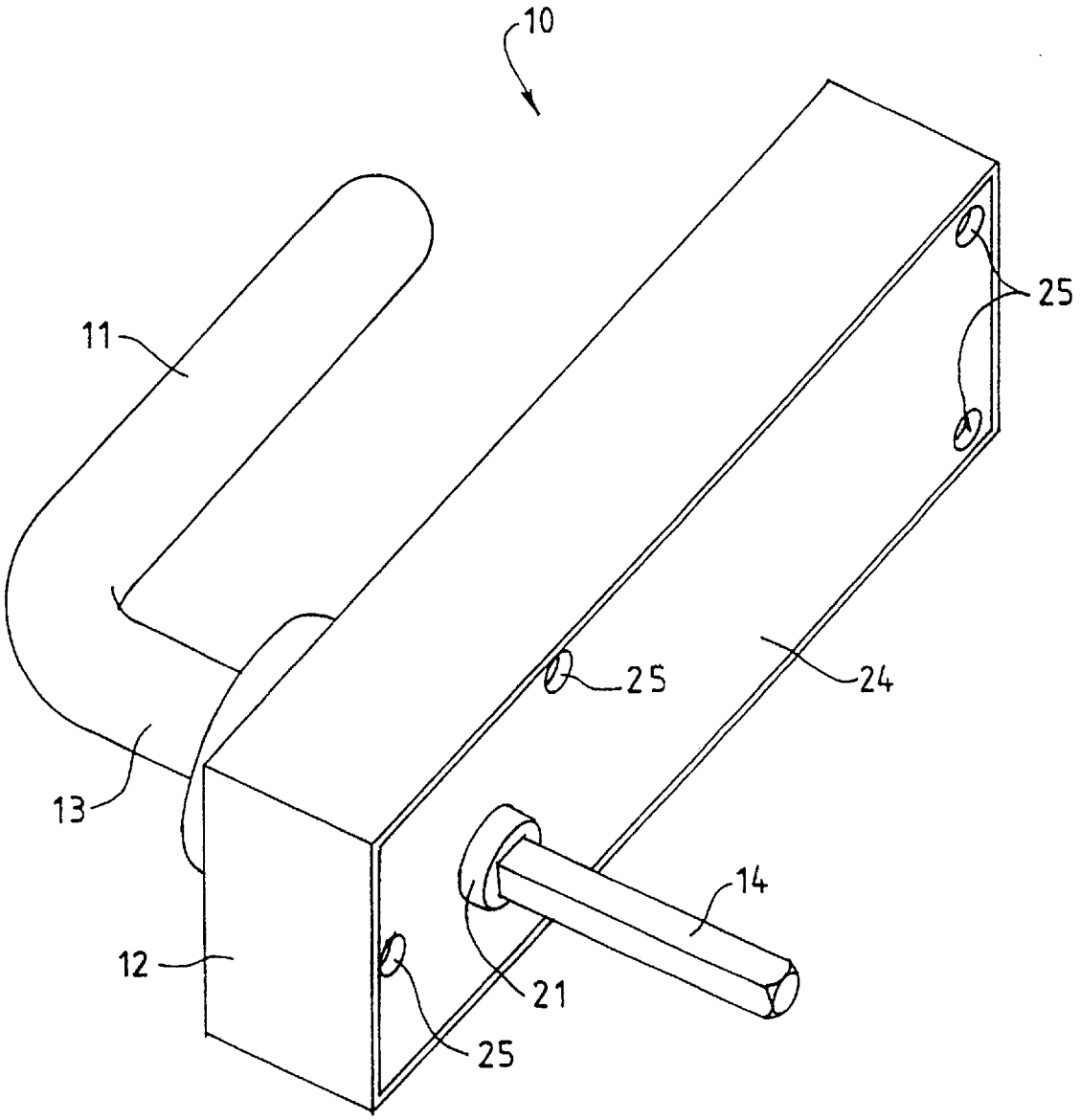
FIG. 3 shows the lock of FIG. 1 as assembled.

The arrangement shown in FIG. 1 further includes a mounting plate 24 and both the mounting plate 24 and the housing 12 include a plurality of openings 25 and 26 respectively for receipt therethrough of fasteners for fastening the lock 10 to a door. A constructed form of the lock 10 not yet fixed to a door is shown in FIG. 3.

Figure 4:
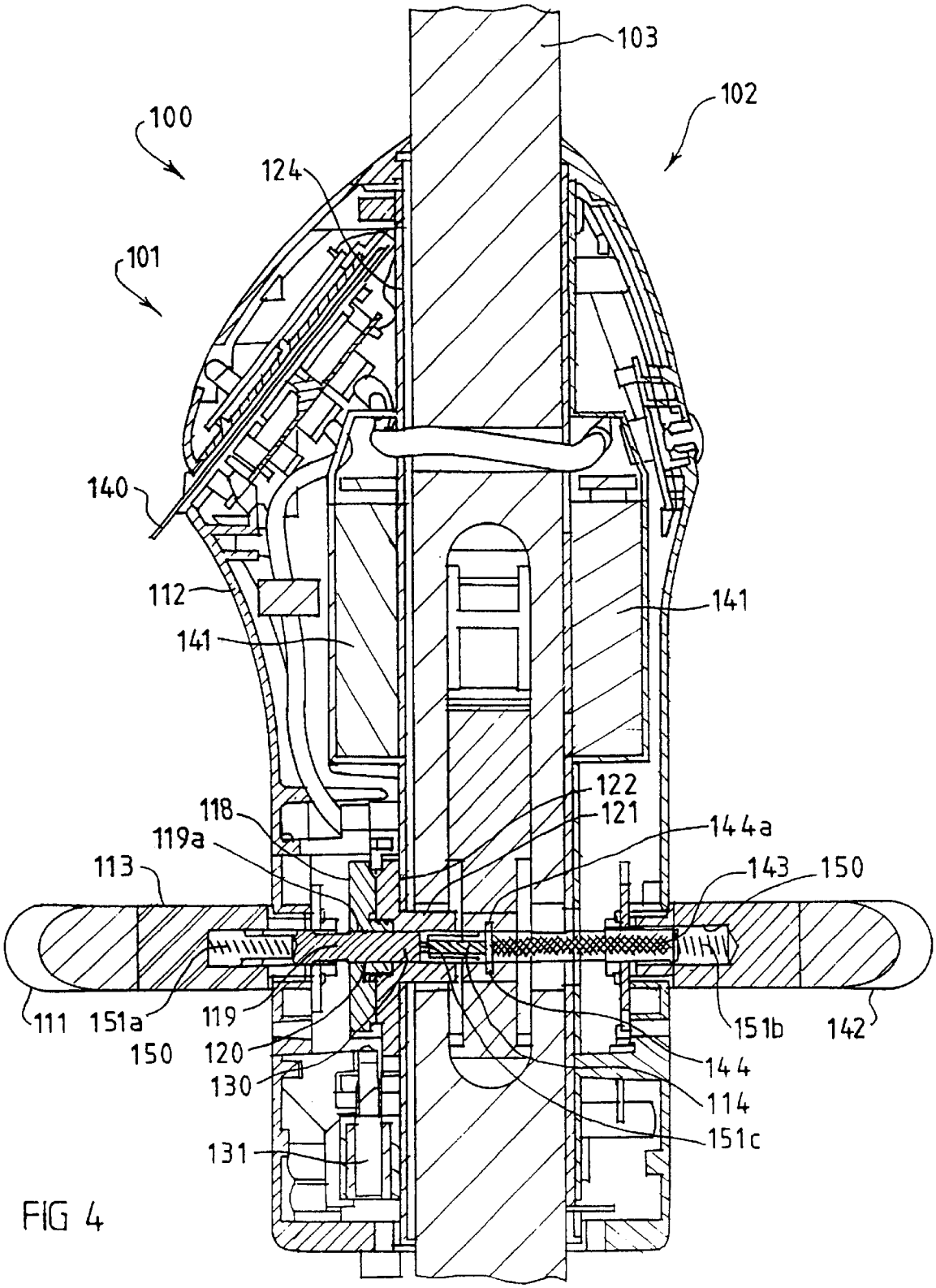
FIG. 4 is a cross-sectional view of a lock according to the invention as fixed to a door.

The lock of FIG. 1 can be fixed to a door and an illustration of such an arrangement is shown in FIG. 4. The lock 100 of FIG. 4 is a modified version of the lock 10 of FIG. 1, although principally it has the same operation. While further reference will be made to FIG. 4 later, it can be noted here that the lock 100 includes two parts 101 and 102 disposed on either side of a door 103. The part 101 is a modified form of the lock 10 and equivalent parts are identified by the same reference numeral, plus 100. Thus, the lock part 101 includes a lever handle 111 which is connected to a spindle 119 and that spindle is engaged within a disc 118 which is driven by the spindle 119 and which forms part of a clutch mechanism. The disc 122 forms the other part of that clutch mechanism and that disc includes a hub 121 which includes an opening to receive a spindle 114 which is connected to a split spindle arrangement that operates a latchbolt retracting mechanism. The split spindle arrangement 144 is of known construction and facilitates retraction of a latchbolt by rotation of one of the spindles 114 or 143 to which it is connected, without disturbing the other of the spindles. The split spindle arrangement 144 includes a divider 144*a*, which can be a washer, located between the ends of the spindles 114 and 144, to separate the spindles. The handles 111 and 142 each include a bore 150 that receives a coil spring 150*a* and 151*b* respectively, which acts against the spindles 119 and 143. The coil spring 151*a* acts against the end of the spindle 119 remote from its connection to the disc 118 and facilitates movement of the spindle (and the disc 118 which is connected to the spindle 119) during engagement and disengagement of the clutch mechanism. The coil spring 151*b* acts against the end of the spindle 143 remote from its connection to the split spindle arrangement 144 and that coil spring ensures that the spindle 143 firmly engages the split spindle arrangement 144. A third coil spring 151*c* acts against the spindle 114 for the same purpose as the coil spring 151*b*, to ensure that the spindle 114 firmly engages within the split spindle arrangement 144. In the arrangement of FIG. 4, it should be noted that the disc 122 is held captive substantially against movement other than rotary movement. Thus, separation of the discs 118 and 122 is caused by linear movement of the disc 118 only. The operation of the lock 100 will be described later.

Figure 7:
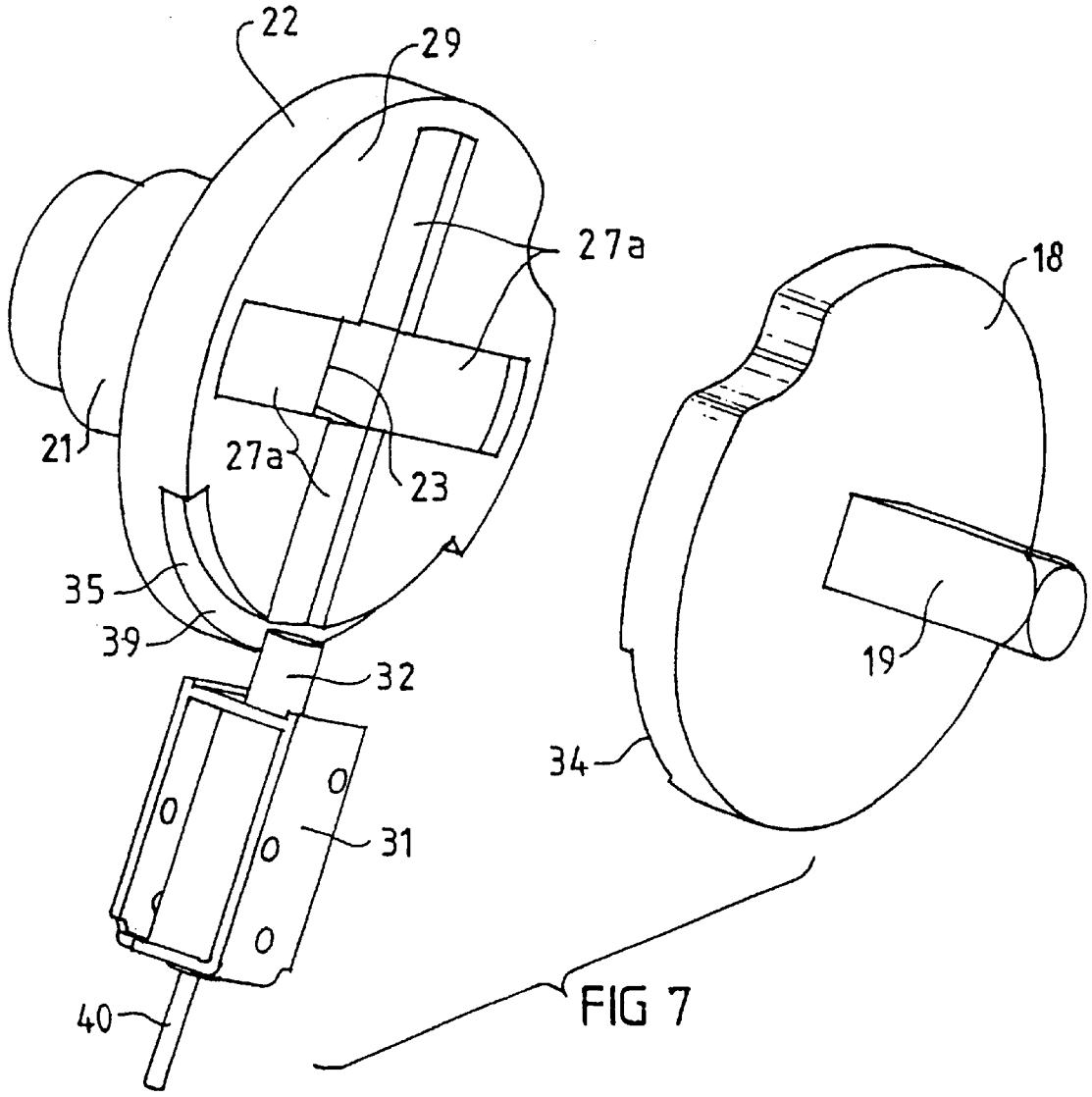
FIG. 7 is a alternative exploded view of the section of the lock shown in FIG. 2.

Referring again to FIGS. 1 and 2, the clutch mechanism includes the discs 18 and 22 and these can be engaged so that the rotational movement of the lever handle 11 can be transmitted to the spindle 14 to retract a latchbolt of the lock and in the arrangement shown, the disc 18 is the drive disc, while the disc 22 is the driven disc. For engagement, the disc 18 includes a plurality of projecting portions 27 which are formed in an engaging face 28 of the disc 18 and which are arranged to be received within recesses 27*a* (see FIG. 7) formed within a corresponding engaging face 29 of the disc 22. The recesses 27*a* do not need to be of complimentary shape to the projecting portions 27 as shown. The spindle 19 includes a locating end spigot 30 that is received within an opening in the disc 22 to locate the discs 18 and 22 relative to each other about a common axis of rotation. The locating spigot 30 is circular in cross-section and can be received within a circular opening in the engaging face 29 of the disc 22, although alternatively, for simplicity of construction, the square opening 23 of the hub 21 may be extended to the engaging face 29 of the disc 22, so that the locating spigot 30 is received within that opening (see FIG. 7). The spigot 30 transmits no rotational movement of the spindle 19 to the disc 22. This arrangement can be seen from FIG. 4 in which the spigot 130 of the spindle 119 extends into the disc 122.

Figure 2:
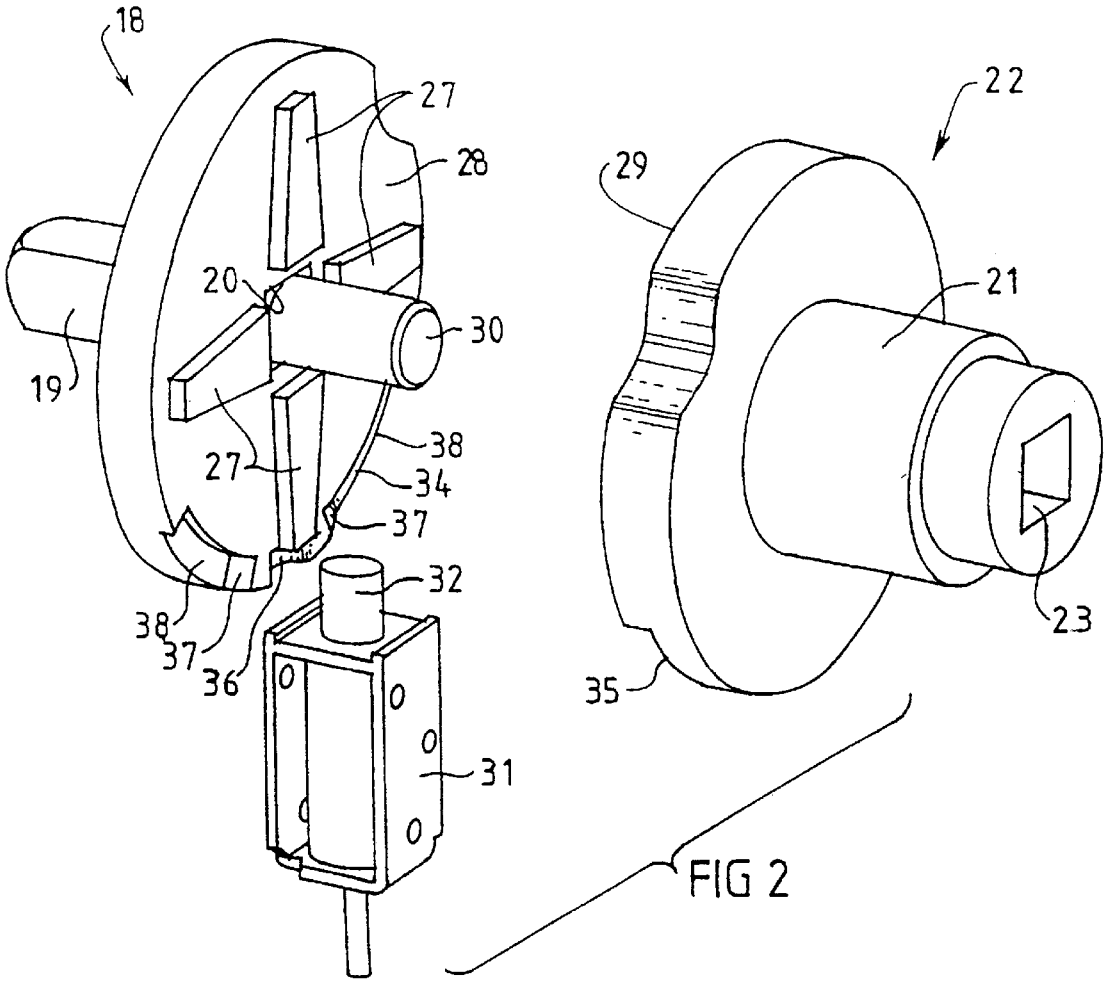
FIG. 2 is an exploded view of the section of the lock shown in FIG. 1.

As described earlier, the disc 18 is driven through the spindle 19 by the lever handle 11, while the disc 22 is connected via the spindle 14 to a latchbolt retracting mechanism for retracting the latchbolt of the lock. Retraction of the latchbolt by rotation of the drive lever 11 is therefore dependent on engagement of the clutch mechanism by way of engagement of the drive disc 18 with the driven disc 22. In the arrangement illustrated, the clutch mechanism is engaged when the projecting portions 27 are received within recesses 27*a* formed in the engaging face 29 of the driven disc 22. In that engaged condition, rotational movement of the lever handle 11 will be transmitted to the spindle 14 for retraction of the latchbolt. In that condition, the lock 10 is therefore unlocked. However, the clutch mechanism of the lock 10 can be disengaged by separation of the discs 18 and 22 to remove the projecting portions 27 from the recesses 27*a*, to prevent rotation of the spindle 14 as a result of rotation of the lever handle 11, and that disengagement is effected by a solenoid actuator 31 that controls an actuating member 32. In FIGS. 1 and 2, the actuating member 32 is the solenoid plunger, although the actuating member could alternatively be remotely located relative to the solenoid actuator 31 and be connected thereto by suitable linkages to the plunger of the solenoid actuator 31. The actuating member 32 is spring biased within solenoid actuator 31 towards an extended position. Actuation of the solenoid actuator 31 by provision of an electric current is such as to withdraw the actuating member 32 within the solenoid actuator 31.

Figure 5:
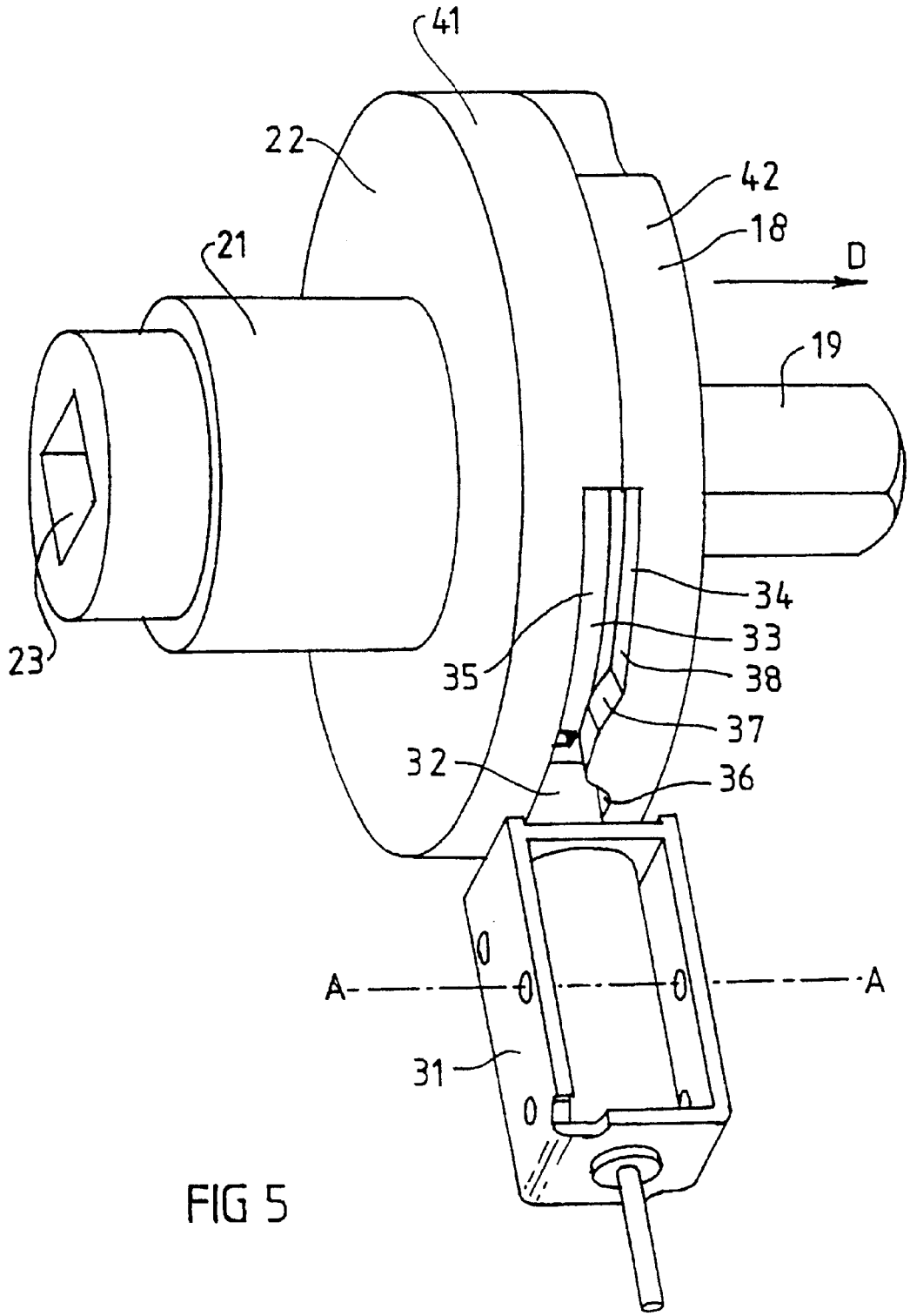
FIG. 5 is an assembled view of the section of the lock shown in FIG. 2.
Figure 6:
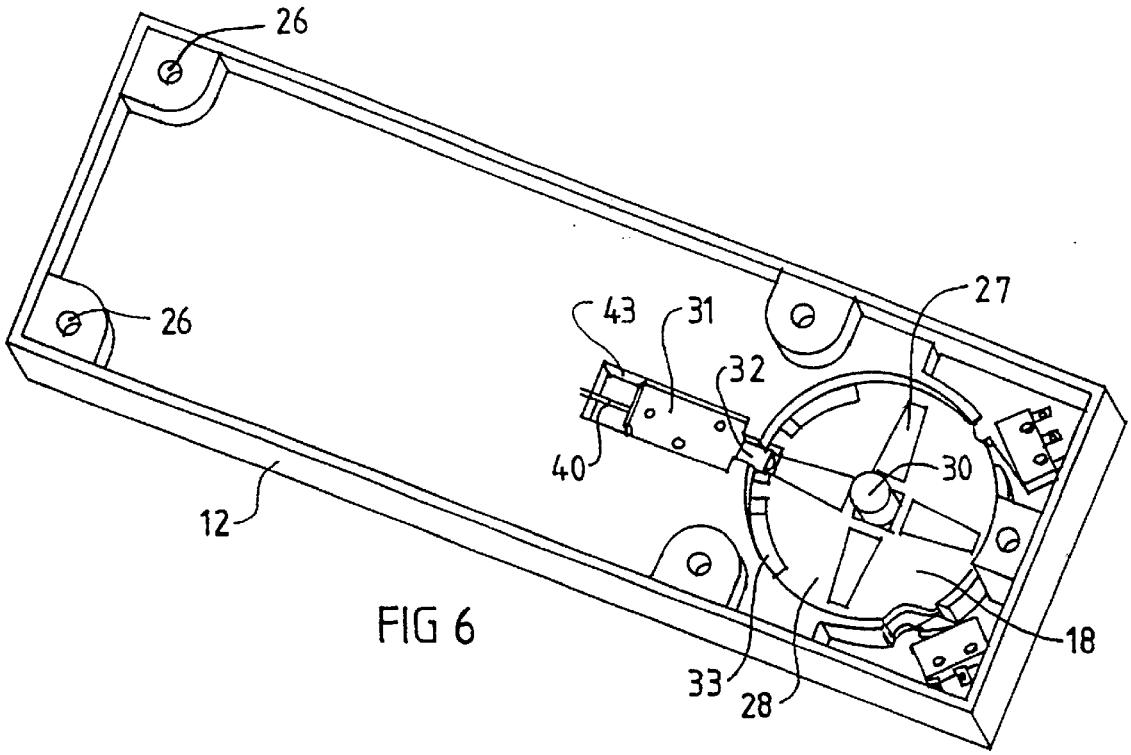
FIG. 6 is a view of one side of a lock assembly according to the invention.

The actuating member 32 is a cylindrical plunger and is controlled by the solenoid actuator 31, which is fixed in a recess 43 (FIG. 6) between a first position in which it can disengage the clutch mechanism and a second position in which it is displaced from the first position. The first position of the plunger 32 is shown in FIGS. 5 and 6. In FIG. 5, the engaging discs 18 and 22 of the clutch mechanism are shown in an engaged condition. In that engaged condition, the plunger 32 extends between the discs 18 and 22 within a recess 33. The recess 33 is formed by recessed sections 34 and 35 in the perimeter of each of the discs 18 and 22 and this can also be seen in FIGS. 2 and 7 in which the discs are separated. In the disc 18, the recessed section 34 includes a part cylindrical section 36 disposed between ramp sections 37 and planar sections 38 (see FIG. 2). In the disc 22, the recessed section 35 is formed as a planar section 39 (see FIG. 7).

The recess 33 accommodates the end section of the plunger 32 at the cylindrical section 36 thereof, in a rest position of the lock 10. The rest position is one in which the solenoid actuator is not activated, nor is the lever handle 11 being manually operated. In the rest position, the lever handle 11 can be disposed in any suitable orientation, but normally will be disposed substantially horizontally. Disposal of the end of the plunger 32 in the cylindrical section 36 of the recess 33 tends to maintain the lock 10 in the rest position by engagement of the plunger 32 against the inside cylindrical wall of the cylindrical section 36.

The rest position of the lock 10 is maintained until a sufficient rotative force is applied to the lever handle 11, whereby the spindle 19 is rotated and that in turn tends to rotate the disc 18. However resistance to rotation of the disc 18 is caused by the inside cylindrical surfaces of the cylindrical section 36 against the plunger 32 and thus for the disc 18 to rotate, it must move in the direction D (see FIG. 5) so that he cylindrical surfaces can ride over the plunger 32. The provision of coil springs within the bores of the handle 11 facilitates that movement and thus the disc 18 can be rotated. The discs 18 and 22 are thus separated and that separation removes the projecting portions 27 from the recesses 27*a*, so that rotation of the disc 18 cannot cause rotation of the disc 22. Continued rotation of the disc 18 by the lever handle 11 will cause the recessed section 34 to continue to rotate relative to the plunger 32 so that the ramp section 37 rides over the plunger 32 to the planar section 38. This will occur regardless of which way the disc is rotated as recessed sections 37 and 38 are disposed on either side of the cylindrical section 36. The lock can therefore be non-handed, ie the handle 11 can be rotated in either direction and the same outcome will result.

Figure 2A:
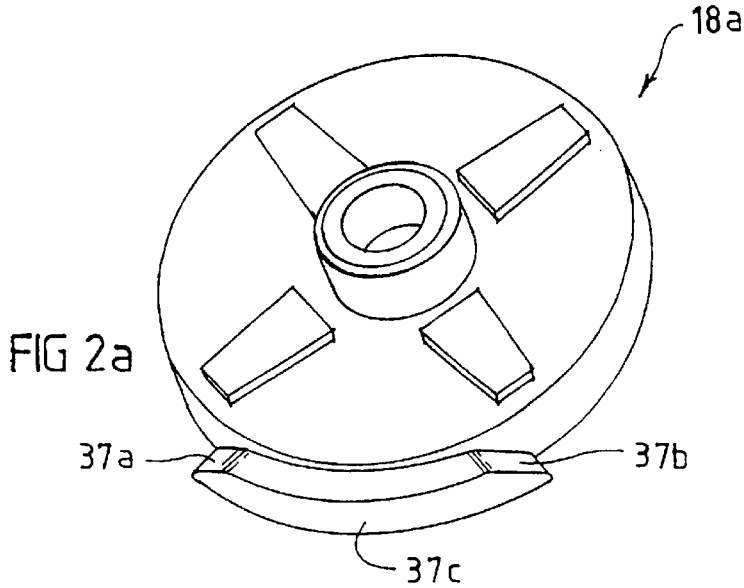

In an alternative arrangement, the lock 10 can instead be constructed to be handed, in either hand direction. A suitable arrangement of this kind is shown in FIG. 2*a* which shows a modified form of the disc 18 of FIG. 2. In FIG. 2*a* the drive disc 18*a* includes two ramp sections 37*a* and 37*b*, which are spaced apart a distance greater than the spacing between the ramp sections 37 shown in FIG. 2.

The arrangement of FIG. 2*a* provides for specific orientation of the disc 18*a* in a suitable lock to facilitate left or right handed operation of the lock. For example, by orienting the disc 18*a* such that the ramp 37*a* is adjacent in use, to the actuating member 32 shown in the lock 10 of FIG. 1, then only rotation of the disc 18*a* in the clockwise direction will cause axial disengaging movement of the disc 18*a* relative to the driven disc 22 of FIG. 1, by virtue of contact between the ramp 37*a* and the actuating member 32. In this example, counterclockwise rotation of the disc 18*a* will result in no axial disengaging movement because there is no surface in that direction against which the actuating member 32 can ride against. However, it is normal in a specifically handed lock that the lever handle or knob for operating the lock is restrained for rotating the disc 18*a* in one direction only. Thus, in such a lock, counterclockwise rotation of the disc would not be possible.

The disc 18*a* shown in FIG. 2*a* is arranged for selective handed operation. That is, the provision of the two spaced apart ramps 37*a* and 37*b* conveniently facilitates adoption of the disc 18*a* in a lock that is either left or right handed. It follows, that the disc 18*a* could include only one ramp section, but that would make it specific for use in either of a left or right handed lock only.

The ramps 37*a* and 37*b* are formed at either end of an annular extension 37*c* which is formed as part of the disc 18*a*. Alternatively, the extension 37*c* could be separately formed and fitted appropriately to the lock to which the disc 18*a* is fitted.

Referring again to FIGS. 5 and 6, it is preferred that there is minimal friction generated between the plunger 32 and the various surfaces of the recess 33, to minimise wear. It is preferable therefore, that during relative rotation between the discs 18 and 22, that there is minimal contact with the plunger 32. That can be achieved by arranging the discs so that in the position shown in FIG. 5, the plunger 32 is not in contact with any surface of the recess 36 or with the planar section 39. When the disc 18 is rotated, the plunger will engage the inside surface of the recess 36, but that engagement can be rolling engagement by the plunger 32 being rotatably held within the solenoid 31. In this arrangement, the plunger will roll out of the recess 36 and on to the ramp section 37. Given that the ramp section 37 is inclined, the disc 18 will move slightly towards the disc 22 as the disc 18 rotates and the plunger 32 moves towards the planar section 38, however movement of the disc 18 toward the disc 22 is retarded when the projecting portions 27 engage against the engaging face 29 of the disc 22 and that engagement will occur when the plunger 32 is still in rolling engagement with the ramp section 37, so that movement of the disc 18 toward the disc 22 is not sufficient for the planar section 38 to engage the plunger 32. Therefore, continued rotation of the disc 18 relative to the disc 22 occurs without engagement of the plunger 32 against the planar surface 38. That is, the depth of the recess 33 proximate the planar section 38 is greater than the diameter of the plunger 32. Given that there is no engagement between the plunger 32 and the planar surface 38, there is no corresponding friction loss. Additionally the plunger is not in contact with the planar section 39, so the entire arrangement generates minimal friction losses. Alternatively, the plunger 32 can engage the planar section 39 in rolling engagement as the disc 18 rotates relative to the disc 22. This arrangement still results in minimal friction losses, as the plunger 32 rolls against the planar section 39 and does not engage the planar section 38.

Thus, at all times while the plunger 32 is received within the recess 33, rotation of the disc 18 will not result in rotation of the disc 22 so that in that position of the plunger 32, the latchbolt of the lock 10 cannot be retracted. Thus, in the position shown in FIG. 5, while the clutch mechanism is in an engaged condition with the disc 18 engaged with the disc 22, as soon as the disc 18 is rotated, the clutch mechanism will be disengaged by separation of the respective discs.

It follows, that for the disc 22 to be rotated so that the latchbolt can be retracted, the plunger 32 must be removed from the recess 33. This is achieved by actuating the solenoid 31 to retract the plunger 32 from the recess 33. Actuation of the solenoid 31 is by way of an electrical circuit and the preferred manner for activating the electrical circuit is by way of an electronic or magnetic key and an arrangement of that kind is shown in FIG. 4 in which an electronic key that transmits or can be read as having the correct signal, causes the electronic reader to send an activating current from one of two batteries 141 to the solenoid actuator 131. Relating this back to FIG. 5, activation of the solenoid actuator 31 retracts the plunger 32 from the recess 33 and the discs 18 and 22 remain engaged during rotation of the disc 18.

The lock as above described is advantageous, in that the only time an electronic current is drawn from the battery supply, is when the lock is to be unlocked. That is, the lock does not require a continuous current to remain in the locked condition and therefore the life of the batteries can be maximum as the lock is envisaged to be installed in installations in which it will predominantly remain locked.

The arrangement for activating the solenoid may take any suitable form which is electrically driven and typically will comprise an electronic or magnetic reader that sends an activating current to the solenoid actuator for a set time period for each insertion or swipe of the electronic or magnetic key or for a continuous period for as long as the key is inserted or placed before the reader. The electronics of such a reader system would be known to a person skilled in the art.

In the arrangement described, the engagement of the plunger 32 in the recess 33 causes separation of the disc 18 and 22 from an engaged condition on rotation of the disc 18 by the lever handle 11 and activation of the solenoid actuator withdraws the plunger so that the discs remain engaged during lever handle rotation. However, the invention is not limited to that kind of movement and may for example work in an opposite manner in which the engaging discs are moved by the plunger from a separated condition to an engaged condition on actuation of the solenoid actuator. In that latter arrangement, the plunger would be withdrawn in the locked condition of the lock so that the discs remained separated and would be extended on activation of the solenoid actuator so that the discs became engaged. A variety of other variations may also be available.

The lock of the invention can be attached to one side of a door, or to both sides of a door as necessary. The lock, when fitted to a single side of a door could for example provide security closure for a storeroom door or for a cupboard door, which is not required to be opened from the other side. Alternatively, the lock could be fitted to both sides of a door when security is required for access from either side. However, the lock of the present invention is considered to have most application to doors in which security unlocking is only required from one side, particularly in respect of hotel guest room doors, or office doors. FIG. 4 is indicative of such an arrangement in which a lever handle 142 is disposed on the inside surface of the door 103 and that lever handle is connected to a spindle 143 which is directly connected to the split spindle arrangement at 144. By that direct connection, any rotation of the lever handle 142 will cause retraction of the latchbolt and therefore, a person seeking to exit through the door 103 from the inside merely needs to turn the lever handle 142 and the door can be opened, whereas entry from the other side of the door requires use of an authorised electronic or magnetic key. The lock parts 101 and, 102 can be disposed either vertically or horizontally, although a vertical arrangement, such as that shown in FIG. 4 is preferred.

The lock of the invention can be used with other locking features and most commonly, a deadbolt may be provided. Such a deadbolt is typically operable separately from other locking components, such as that of the invention and, it should be appreciated that where previously it has been stated that disengagement of the clutch mechanism unlocks the lock, that is dependent on all other locking components associated with the lock also being disabled.

The lock of the invention further includes an override mechanism to override the electronic control of the lock. The override mechanism may be activated if an authorised electronic key has been lost or misplaced, or if the system has jammed, for example when the battery power has been exhausted, or it may be activated to place the lock in an unlocked condition for an extended period, such as during the day, or when permanent access is required. The override mechanism of the invention can take various forms and principally requires removal of the plunger from the position in which it causes disengagement of the clutch mechanism upon rotation of the lever handle or other drive member.

Figure 9:
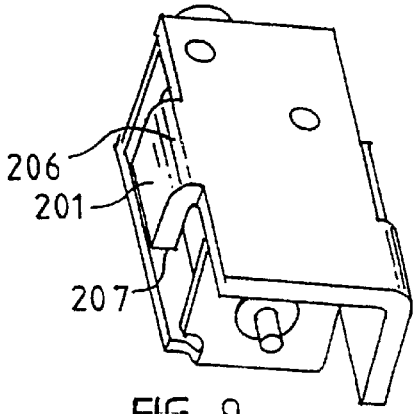
Figure 10:
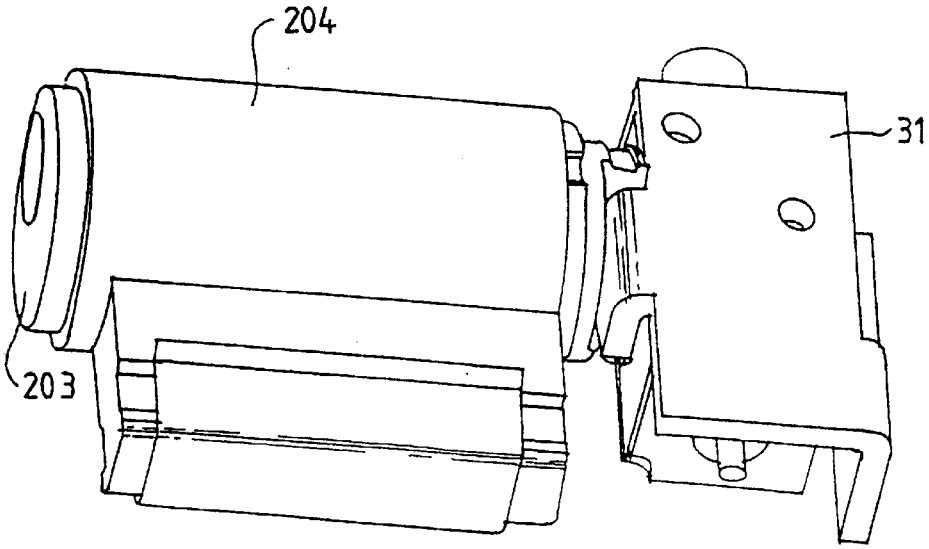

In a first form, the override mechanism operates to rotate the plunger to a position at which it cannot adopt the disengagement position. The plunger preferably can be rotated in this manner when disposed in either of the positions to which it is moved by the solenoid actuator, although in a less preferred alternative arrangement, the plunger can only be rotated when disposed in a retracted position. An example of a rotatable override mechanism is shown in FIGS. 8 to 10.

Figure 8:
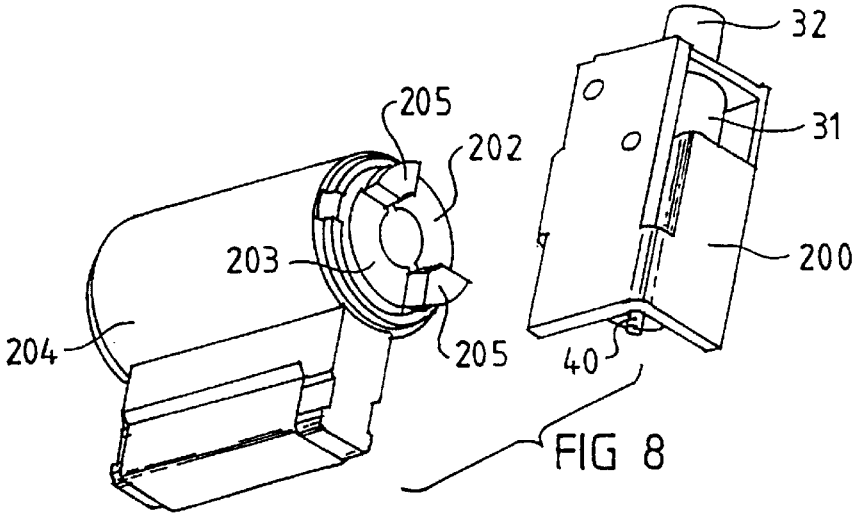
FIGS. 8 to 10 show an override mechanism according to the invention.

FIG. 8 shows the solenoid actuator 31 fixed within a mounting bracket 200, with the plunger 32 extending from one end and the electrical connection 40 extending from the other end. The mounting bracket 200 and the solenoid actuator 31 are shown from a different angle in FIG. 9 and in that figure, an attachment member 201 is shown and that member is attachable by any suitable means to the end 202 of the barrel 203 of a cylinder assembly 204. In the arrangement of FIG. 8, the barrel end 202 includes a pair of lugs 205 and these are arranged to engage the attachment member 201 of the mounting bracket 200 as shown in FIG. 10. As shown, the lugs 205 engage the attachment member 201 on the upper and lower surfaces 206 and 207 thereof.

Rotation of the solenoid actuator 31 is effected by rotation of the barrel 203 by key operation. Referring to FIG. 5, the solenoid actuator 31 is rotated about the axis AA in a direction into or out of the page. By that rotation, the end of the plunger 31 will engage the inside surface of the cylindrical section 36 of the recess 33, but the biased mounting of the disc 18 allows that disc to shift axially to permit the rotational movement of the solenoid actuator 31. Alternatively, the biased mounting of the plunger 32 within the solenoid actuator 31 may also facilitate that rotation. Alternatively, if the electronic key is available, the solenoid actuator can be actuated to withdraw the plunger, followed then by rotation of the barrel 203.

The barrel rotation is preferably limited to less than 360°, to ensure that the key used to turn the barrel cannot be removed with the plunger still displaced. An abutment within the lock housing can restrict the rotation of the solenoid actuator.

In return movement of the solenoid actuator 31, the plunger can engage the side surfaces 41 and 42 of the discs 18 and 22 and that engagement will tend to push the plunger 32 against the spring bias, so that the plunger can ride over those sides until the cylindrical section 36 of the recess 33 is reached and the plunger 32 enters the recess 33 at that position.

Figure 11:
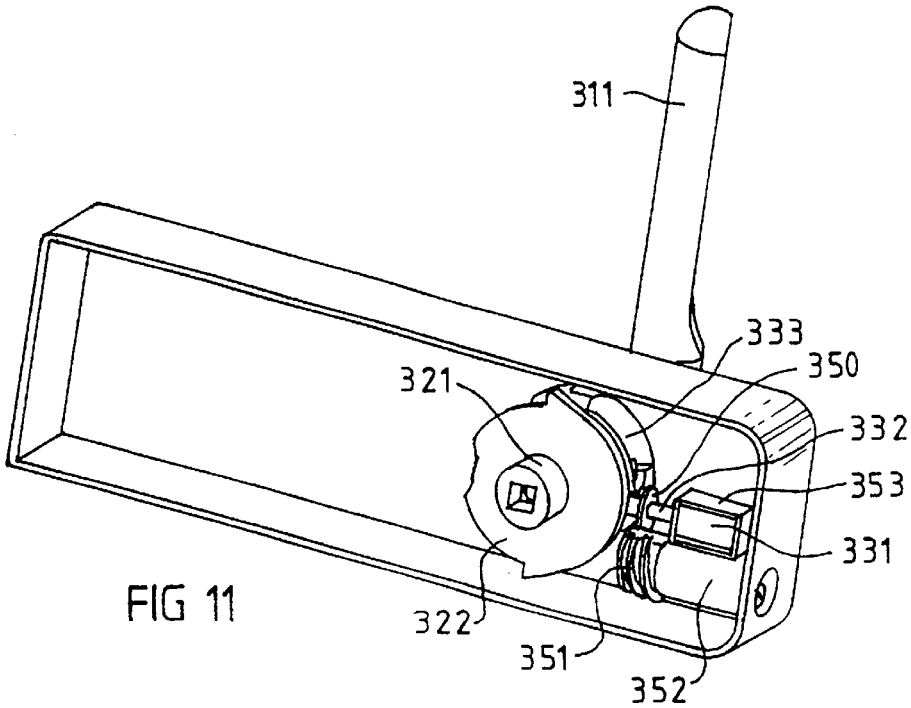
FIG. 11 shows an alternative override mechanism according to the invention.

An alternative override mechanism is shown in FIG. 11 in which features corresponding to those of the apparatus of FIGS. 1 to 9 have the same reference numeral plus 300. In this embodiment, the plunger 332 includes a skirt 350 and the edge of that skirt is arranged to be engaged by a threaded member 351 of an override mechanism. The threaded member 351 is rotatably fixed to the barrel of a cylinder assembly 352 and is key operable to rotate the barrel and withdraw the end of the plunger 332 from within the recess 333. The threaded member 351 is spaced from the skirt 350 until such time as the override mechanism is activated. A gap between the threaded member 351 and the skirt 350 leaves the plunger 332 free to move between retracted and extended positions, but rotation of the threaded member 351 brings the threaded member into engagement with the skirt 350, to retract the plunger 332 from engagement with the clutch mechanism. The gap can be provided by removing a portion of the threaded member 351, such as by removing a scalloped portion of a similar radius to the skirt 350. Alternatively, the threaded member could be rotated eccentrically into engagement with the skirt 350. This arrangement can also employ an abutment to prevent rotation of the barrel about 360° and the skirt 350 may provide that abutment by engaging against the forward end of the solenoid actuator 331 or the mounting bracket 353.

The invention described herein is susceptible to variations, modifications and/or additions other than those specifically described and it is to be understood that the invention includes all such variations, modifications and/or additions which fall within the spirit and scope of the above description.

What is claimed is:

1. An electrically controlled lock, including a retractable latchbolt and a clutch mechanism disposed between a latchbolt retracting mechanism for retracting said latchbolt and a drive member for driving said latchbolt retracting mechanism, said clutch mechanism including first and second engageable bodies which are connected to said drive member and said latchbolt retracting mechanism respectively, so that said drive member is operable to rotate said first engageable body and said latchbolt rectracting mechanism is operable upon rotation of said second engageable body, said engageable bodies being relatively movable between an engaged condition in which drive of said drive member is transmitted to said latchbolt retracting mechanism for retracting said latchbolt, and a disengaged condition in which transmission of drive between said drive member and said latchbolt retracting mechanism is interrupted so as to prevent retraction of said latcbbolt, said relative movement of said engageable bodies occurring as a result of engagement of at least one of said bodies with an actuating member which is controlled by electrical actuating means to move between a non-actuated and an actuated position, in said non-actuated position said actuating member is disposed between said engageable bodies and is operable, upon drive by said drive member to rotate said first engageable body, to engage at least one of said first and second engageable bodies and to cause them to disengage, and in said actuated position, said actuating member is positioned to permit said engageable bodies to remain engaged upon rotation of said first engageable body by said drive member for transmission of drive through said second engageable body to said latchbolt retracting mechanism.

2. An electrically controlled lock according to claim 1, said actuating means including an electric motor that drives said actuating member.

3. An electrically controlled lock according to claim 1, said actuating means including a solenoid and the actuating member being a plunger driven by said solenoid.

4. An electrically controlled lock according to claim 1, said drive member being manually operable and in the form of a lever or knob.

5. An electrically controlled lock according to claim 1, said lock including a drive member disposed on each of opposite sides thereof, said drive member being a first drive member and said lock including a second drive member for directly driving said latchbolt retracting mechanism.

6. An electrically controlled lock according to claim 1, one of said engageable bodies including at least one protruding portion for receipt, in the engaged condition of the engageable bodies, in a recess portion of the other of said engageable bodies.

7. An electrically controlled lock according to claim 1, each of said engageable bodies being rotatable about a common axis.

8. An electrically controlled lock according to claim 7, in said engaged condition of said engageable bodies, a recess being formed in the peripheral edge of one or both of said bodies, to accommodate an end portion of said actuating member, said recess being shaped so that rotation of said first engageable body by said drive member relative to said end portion of said actuating member causes axial movement of one or both of said engageable bodies to said disengaged condition.

9. An electrically controlled lock according to claim 8, said recess including a ramp surface which rides over said end portion upon rotation of said first engageable body.

10. An electrically controlled lock according to claim 8, said recess including a pair of ramp surfaces so that said end portion rides over one of said ramp surfaces depending on the direction of rotation of one or both of said engageable bodies.

11. An electrically controlled lock according to claim 8, wherein said end portion is accommodated within said recess without contact with either of said engageable bodies until one or both of said bodies is driven to rotate.

12. An electrically controlled lock according to claim 8, said actuating member being cylindrical and defining a longitudinal axis and being rotatable about said longitudinal axis to roll in engagement with said recess.

13. An electrically controlled lock according to claim 1, said first engageable body being connected for rotation with said drive member on a spindle and relative movement between said engageable bodies being by way of sliding movement of said first engageable body axially along said spindle.

14. An electrically controlled lock according to claim 1, wherein relative movement of said engaging bodies is, in one direction, against the influence of biasing means.

15. An electrically controlled lock according to claim 1, said electrical actuating means being battery powered.

16. An electrically controlled lock according to claim 1, wherein said electrical actuating means draws current only in one of said non-actuated or actuated positions of said actuating member.

17. An electrically controlled lock according to claim 1, including an override mechanism which prevents disengagement of said engageable member.

18. An electrically controlled lock according to claim 17, said override mechanism being operable to displace said actuating member away from said engaging bodies.

19. An electrically controlled lock according to claim 18, said movement of said actuating member away from said engaging bodies being rotary movement.

20. An electrically controlled lock according to claim 19, said override mechanism including a barrel lock, the barrel of which is attached to said actuating means and wherein rotation of said barrel by key operation causes rotation of said actuating means to displace said actuating member away from said engaging bodies.

21. An electrically controlled lock according to claim 17, said override mechanism and said actuating means being arranged for threaded engagement such that relative threaded rotation between said actuating member and said override mechanism causes movement of said actuating member to said actuated position.

22. An electrically controlled lock according to claim 21, wherein said actuating member includes a skirt and said override mechanism includes a rotatable threaded portion for engagement of said skirt for linear movement of said actuating member on rotation of said threaded portion.

* * * * *